United States Patent [19]

Kephart, Jr.

[11] 4,151,687

[45] May 1, 1979

[54] DEVICE FOR SECURING STRUCTURAL PANELS

[76] Inventor: John W. Kephart, Jr., P.O. Box 59, Alder, Mont. 59710

[21] Appl. No.: 880,010

[22] Filed: Feb. 21, 1978

[51] Int. Cl.[2] ..... E04B 1/344

[52] U.S. Cl. ..... 52/71; 52/631

[58] Field of Search ..... 52/64, 70, 71, 631; 135/1 R, 4 R

[56] References Cited

U.S. PATENT DOCUMENTS

| | | | |
|---|---|---|---|
| 3,018,857 | 1/1962 | Parham | 52/71 X |
| 3,251,382 | 5/1966 | Tatsch | 52/631 X |
| 3,564,785 | 2/1971 | Kephart | 52/71 |
| 3,649,398 | 3/1972 | Keith | 52/631 |
| 3,731,449 | 5/1973 | Kephart | 52/71 X |
| 3,854,746 | 12/1974 | Flynn | 135/1 R |
| 3,969,868 | 7/1976 | Bainter et al. | 52/631 |

*Primary Examiner*—J. Karl Bell

*Attorney, Agent, or Firm*—Louis V. Schiavo

[57] ABSTRACT

Structural panels are assembled and set up to afford a knock-down shelter comprising a roof which spans opposed upright sidewalls. The roof and sidewall panels are detachably secured together by devices provided with interlocked parts respectively carried by the roof and sidewall panels. The interlocked parts automatically interlock while the panels are being assembled and set up to form the shelter and automatically disengage while the shelter is being knocked down.

14 Claims, 17 Drawing Figures

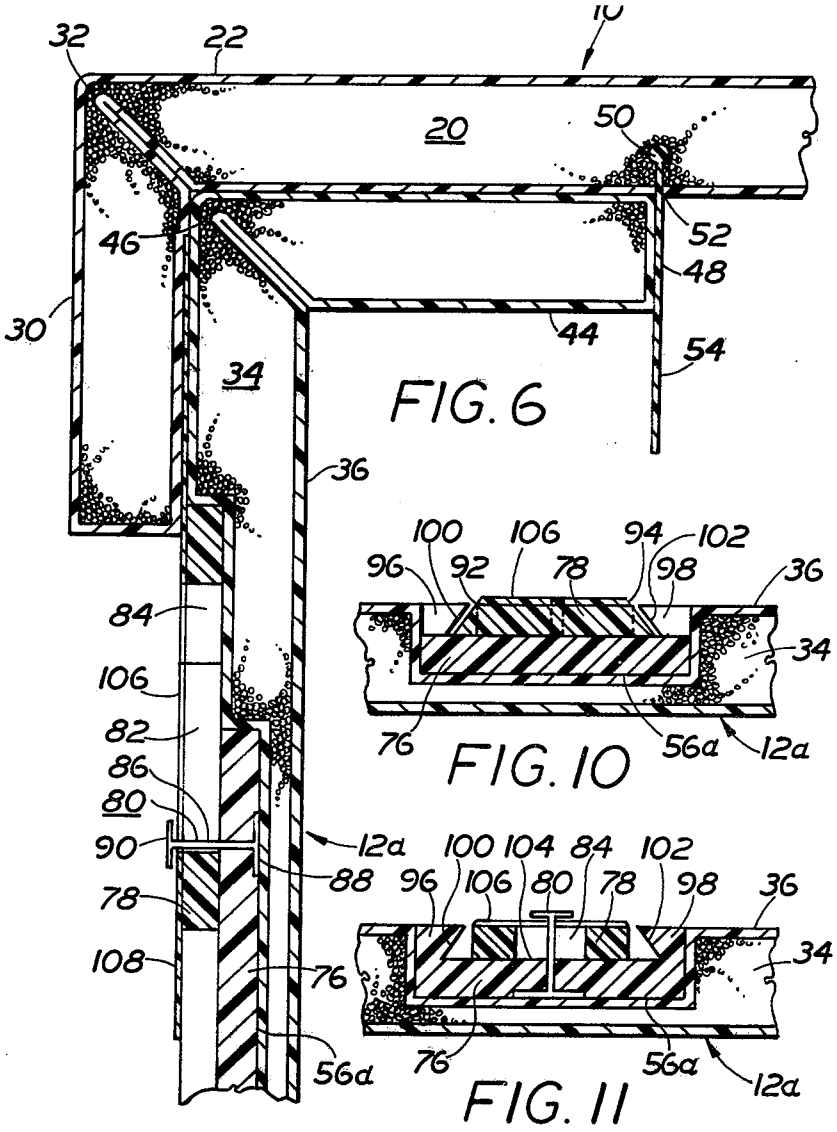
FIG. 6
FIG. 10
FIG. 11
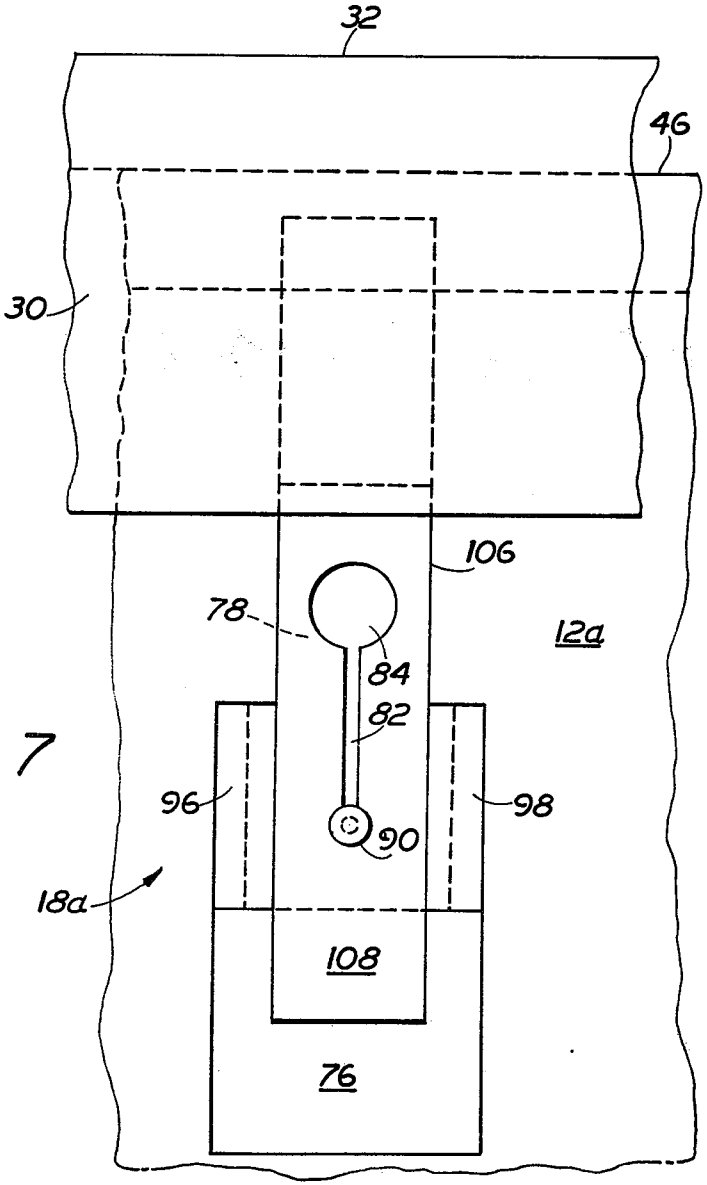
FIG. 7

DEVICE FOR SECURING STRUCTURAL PANELS

BACKGROUND OF THE INVENTION

1. Field of the Invention

The present invention relates to structural panels provided with devices for detachably securing them together.

2. Description of the Prior Art

In my U.S. Pat. No. 3,564,785, issued Feb. 23, 1971, describe a building structure adapted for being knocked down, moved to a new site and re-erected. The building structure comprises roof panels which span and are supported upon opposed upright sidewall panels. In the erection of the building structure the initial operation of assembling the roof and sidewall panels and setting them up for being secured together is followed by the separate and distinct operation of interconnecting the roof and sidewall panels at the juncture thereof, along the eave of the building structure, as by staples or some such mechanical means. In knocking the building down, first the mechanical connection between the roof and sidewall panels is broken. Then in a separate and distinct operation, the roof and sidewall panels are separated.

SUMMARY OF THE INVENTION

An object of the present invention is to provide a pair of structural panels with devices which detachably secure them together automatically while they are being assembled and set up to form a knock-down structure, and which release the panels automatically while the structure is being knocked down, thus accomplishing in one and the same operation what formerly required two separate and distinct operations.

BRIEF DESCRIPTION OF THE DRAWINGS

FIG. 6 is similar to FIG. 2, but shows how the roof panel is detachably secured to the sidewall panel by a modified device;

FIG. 7 is a view of the panel securing device illustrated in FIG. 6, looking at it from outside the shelter;

FIG. 10 is a section on line X—X in FIG. 9;

FIG. 11 is a section on line XI—XI in FIG. 9;

DESCRIPTION OF THE PREFERRED EMBODIMENT

Figure 1:
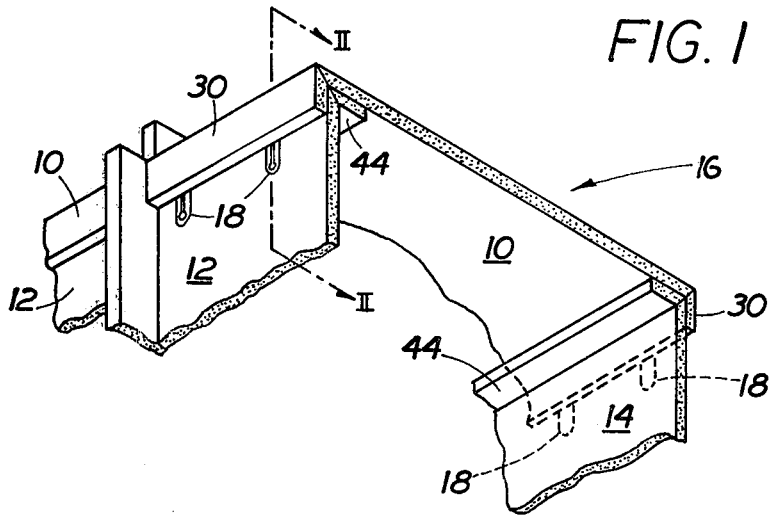
FIG. 1 is a fragmentary perspective section looking upwardly and at one side of a shelter formed by a roof panel spanning opposed upright sidewall panels.

The following description is directed to the specific embodiments of the invention disclosed in the drawings. It is not addressed to the scope of the invention, which may be practiced in a variety of forms.

Referring to FIGS. 1–5 of the drawings, and particularly to FIG. 1 thereof, a roof panel 10 spans a pair of opposed upright sidewall panels 12 and 14 to thereby provide a building structure or shelter generally designated 16. Reference may be had to my U.S. Pat. No. 3,564,785, issued Feb. 23, 1971, for disclosure of a building structure or shelter of the type referred to. The opposite end portions of the roof panel 10 are supported respectively upon the sidewall panels 12 and 14 and are detachably secured thereto by panel securing devices 18.

Preferably, each of the panels of the building structure or shelter 16 comprises a thick core of foamed plastic material sheathed with a sheet of plastic material bonded to the core. Extending into the panel and along selected marginal areas thereof is a wide angle V-shaped groove of a depth sufficient to sharply reduce the thickness of the core and divide the panel into main body and flange parts interconnected by a hinge formation consisting of the area of the core sharply reduced in thickness by the groove, and of the associated areas of the sheet of plastic material bonded to the core. Reference may be had to my U.S. Pat. No. 3,731,449, issued May 8, 1973, for a suitable construction wherein both the core and the sheathing therefor are of urethane.

Figure 4:
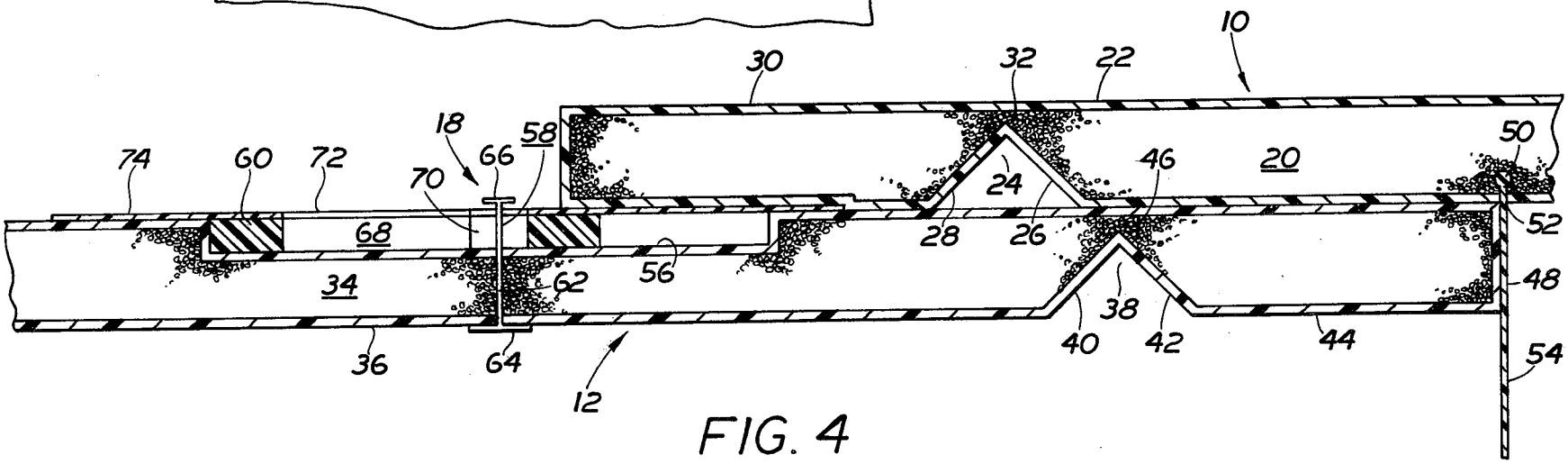
FIG. 4 is similar to FIG. 2, but shows the roof and sidewall panels in an initial stage of assembly, before the panels are fully assembled and set up and thereby detachably secured together.

More particularly, referring to FIG. 4, the roof panel 10 comprises a thick core 20 of foamed plastic material sheathed with a sheet of plastic material 22 bonded to the core. Extending into the undersurface of the roof panel 10 is a groove 24 having opposite sides 26 and 28 angularly spaced approximately 90 degrees apart, and having a depth sufficient to sharply reduce the thickness of the core and thereby divide the panel into a main body part and a flange part 30 interconnected by a hinge formation, designated 32. Still referring to FIG. 4, the sidewall panel 12 comprises a thick core 34 of foamed plastic material sheathed with a sheet of plastic material 36 bonded to the core. Extending into the undersurface of the sidewall panel 12 is a groove 38 having opposite sides 40 and 42 angularly spaced approximately 90 degrees apart, and having a depth sufficient to sharply reduce the thickness of the core and thereby divide the panel into a main body part and a flange part 44 interconnected by a hinge formation, designated 46.

Again referring to FIG. 4, affixed by any suitable means to the narrow edge of the flange 44 is a strip of plastic material 48, the longitudinally extending upper marginal area of which forms a bead 50 detachably force-fitted into a narrow slot 52 in the undersurface of the roof panel 10, and the longitudinally extending lower marginal area of which extends below the flange 44 a distance sufficient to afford a pull-tab 54. The roof and sidewall panels are shown in an initial stage of assembly—before the roof panel 10 is elevated to allow the sidewall panels to fold inwardly and downwardly toward the underside of the roof panel to an upright position. When the strip 48 is engaged in the slot 52 the side 26 of the groove 24 and the side 42 of the groove 38 are aligned and disposed approximately in coplanar relation.

Figure 5:
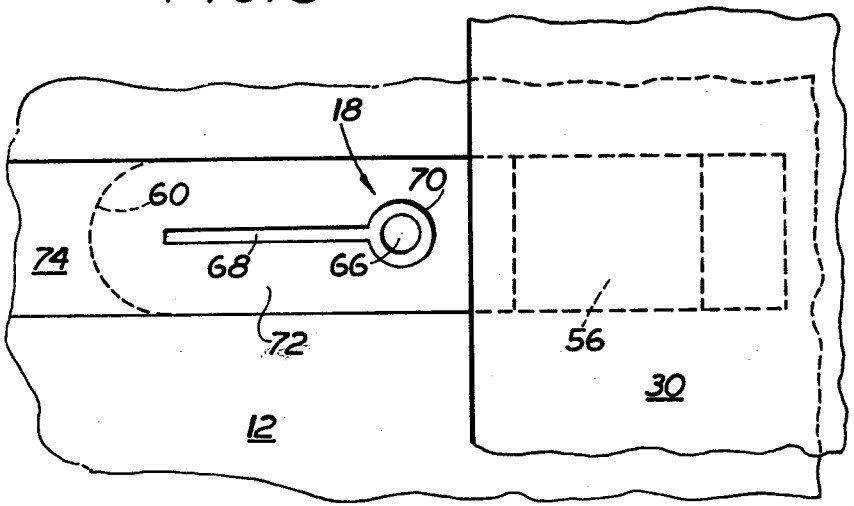
FIG. 5 is a view looking at the panel securing device, as illustrated in FIG. 4.

Now referring particularly to FIGS. 4 and 5, the outer surface of the sidewall panel 12 is depressed, as at 56, to accommodate a device 18 comprising parts 58 and 60 operable for interlocking and thereby detachably securing the roof and sidewall panels together. The part 58 extends through the sidewall panel and is firmly embedded therein. The stem of the part 58, designated 62, extends through the bottom of the depression 56 and terminates at opposite ends respectively in enlarged heads 64 and 66. The part 60 is a plate member slidably nested in the depression 56 and provided with a keyhole shaped slot 68 enlarged at one end, as at 70. The part 60 is affixed to the flange 30 of the roof panel 10 by a flexible strip of sheet material 72, one end portion of which underlies the flange 30, the intermediate portion of which overlies the part 60 and the opposite end portion of which extends beyond the part 60 to provide a pull-tab 74. The strip may be affixed by any suitable means to the flange 30 of the roof panel 10 and to the part 60. The part 58 is concentric with the enlargements of the keyhole slots in the part 60 and the strip 72, as best shown in FIG. 5, and, as a consequence, the parts 58 and 60 are not interlocked. The minimum length of the slot 68 is critical. The length of the slot, i.e., from the center of the enlargement 70 to the opposite end of the slot must be at least sufficient to allow relative movement of the parts 58 and 60 in the order of twice the thickness of the roof panel 10. Preferably, the part 58 is made of metal, and the part 60 and strip 72 are made of suitable plastic material.

Figure 3:
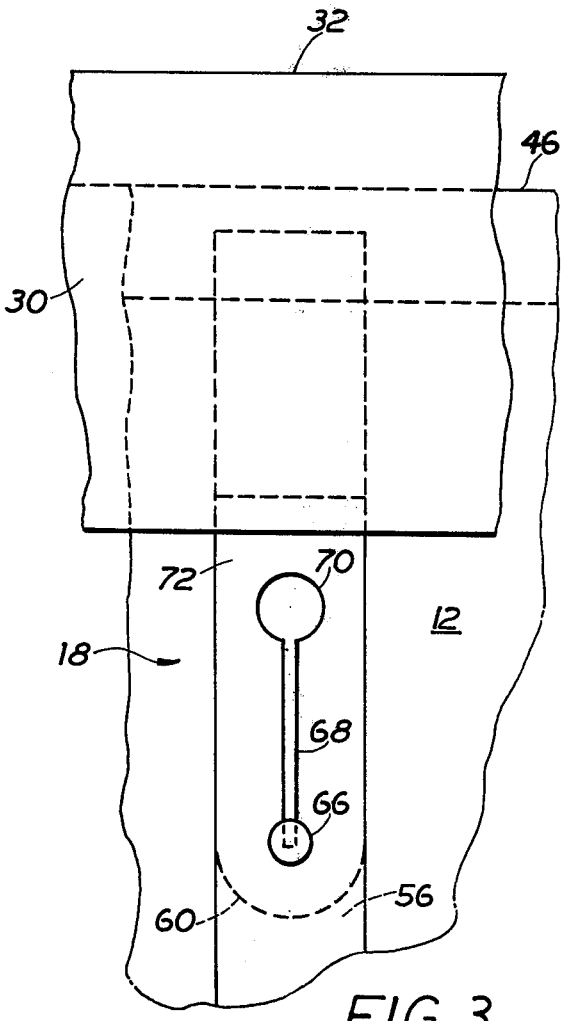
FIG. 3 is a view of the panel securing device illustrated in FIG. 2, looking at it from outside the shelter.
Figure 2:
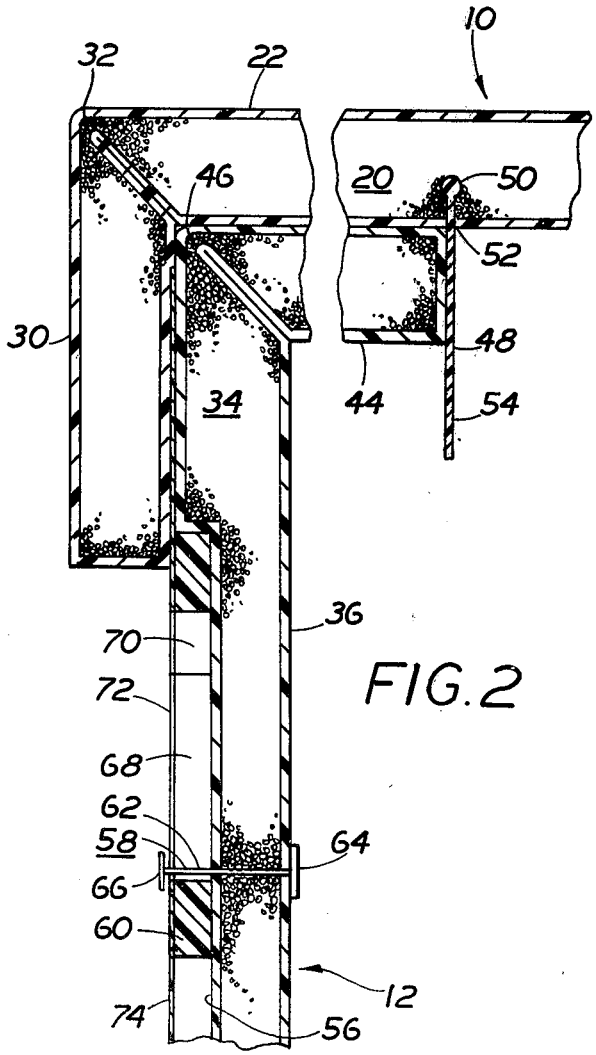
FIG. 2 is an enlarged section on line II—II in FIG. 1, showing how the roof panel is detachably secured to the sidewall panel.

In order to assemble and set up the building structure or shelter, the roof and sidewall panels are initially arranged as shown in FIGS. 4 and 5, i.e., with the plane of the interface between them disposed horizontally. Then, maintaining the roof panel in a horizontal position, it is raised. As the roof panel is elevated the sidewall panel and the flange 30 of the roof panel fold inward and downward toward the underside of the roof panel until the sidewall panel is in an upright position, as shown in FIGS. 1—3. In the meantime, due to folding of the flange 30, the part 60 of the device 18 slides upwardly in the depression 56, and the part 58 moves downwardly to the bottom of the slot 68 with its head 66 overhanging the opposite sides of the slot. Thus, the flange 30, and consequently the roof panel, is detachably secured to the sidewall panel automatically as an incident of assembling and setting up the panels in position. Assembling and setting up of the panels and securing them together are not separate and distinct operations. They are part and parcel of the same operation. Likewise, dismantling the building structure or shelter after the roof and sidewall panels have been assembled, set-up and detachably secured together, as illustrated in FIG. 2, and returning it to the condition thereof illustrated in FIG. 4 is effected in a single operation. The roof panel is relowered. As a consequence, the sidewall panel and the flange 30 of the roof panel are unfolded, i.e., they are turned upwardly and outwardly respectively about the hinges 46 and 32 until the interface between the panels is approximately in a horizontal position, as shown in FIG. 4. As the roof panel is lowered the part 60 of the device 18 returns to its initial position in the depression 56. If need be, use is made of the pull-tab 74. The part 58 moves relative to the part 60 in the opposite direction back to the initial position thereof, finally registering with the enlargement 70 of the slot 68, as shown in FIG. 4. Thus, the flange 30, and consequently the roof panel, is detached from the sidewall panel automatically as an incident of lowering the roof panel and unfolding the sidewall panel and the flange 30 of the roof panel. Detaching the panels from each other and knocking them down are not separate and distinct operations. They are part and parcel of the same operation. Complete separation of the sidewall panel from the roof panel is effected by using the pull-tab 54 to pull the bead 50 out of the slot 52.

Figure 9:
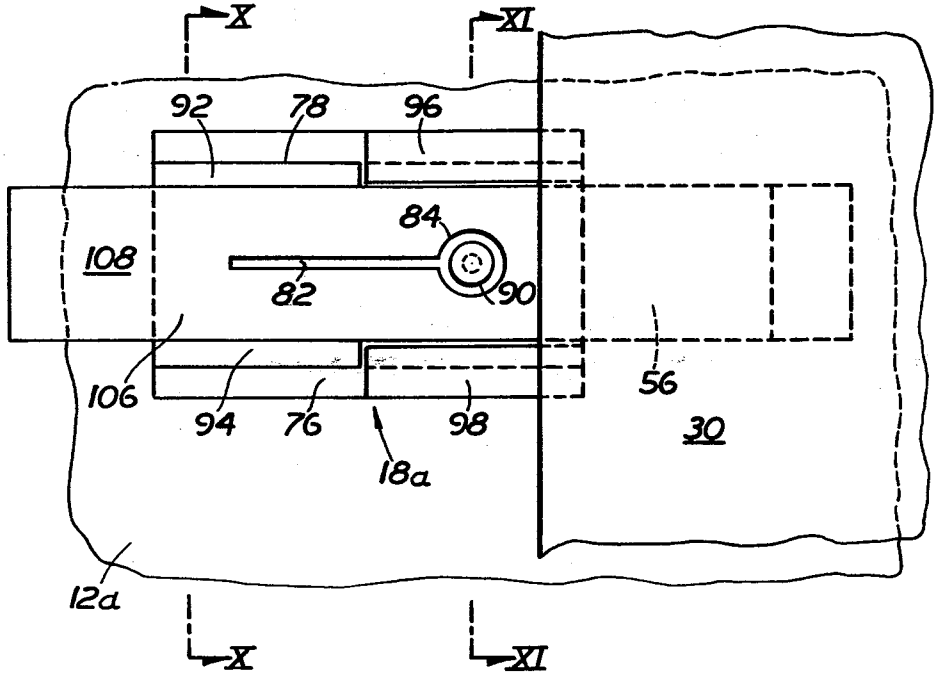
FIG. 9 is a view loooking at the panel securing device, as illustrated in FIG. 8.

A modified device for detachably securing the roof and sidewall panels together is illustrated in FIGS. 6–11. Referring particularly to FIGS. 8–11, the device, designated **18*a*, comprises parts 76, 78 and 80. The parts 76 and 78 are plate members, the former being fixedly nested in the deeper part of a stepped depression 56*a* in the sidewall panel, designated 12*a*, while the latter overlies the part 76 and is slidably seated thereon. The part 78 is provided with a keyhole shaped slot 82 enlarged at one end, as at 84. The part 80 extends through the part 76 and is firmly anchored thereto. The stem of the part 80, designated 86, extends through the center of the enlargement 84 and terminates at opposite ends respectively in enlarged heads 88 and 90. At one end of the part 78, the opposite side narrow edges are beveled, as at 92 and 94. At the end of the part 76 remote from the beveled end of the part 78 the opposite sides are provided with raised flanges, designated 96 and 98. The opposed surfaces of the flanges are beveled, as at 100 and 102, to complement the bevels 92 and 94 of the part 78, and to thereby afford a way 104 for guiding the part 78 in its movement back and forth over the part 76. The part 78 is affixed to the flange 30 of the roof panel 10 by a flexible strip of sheet material 106, one end portion of which underlies the flange 30, the intermediate portion of which overlies the part 78 and the opposite end portion of which extends beyond the part 78 to provide a pull-tab 108. The strip may be affixed by any suitable means to the flange 30 of the roof panel 10 and to the part 78. The part 80 is concentric with the enlarged areas of keyhole slots in the part 78 and the strip 106, as best shown in FIG. 9. In addition, the beveled end of the plate member 78 is not engaged in the way 104. As a consequence, the parts 76, 78 and 80 are not interlocked. The minimum length of the slot 82 is critical. The length of the slot, i.e., from the center of the enlargement 84 to the opposite end of the slot must be at least sufficient to allow relative movement of the parts 78 and 80 in the order of twice the thickness of the roof panel 10. Preferably, the part 80 is made of metal, and the parts 76 and 78 and the strip 106** are made of a suitable plastic material.

Figure 8:
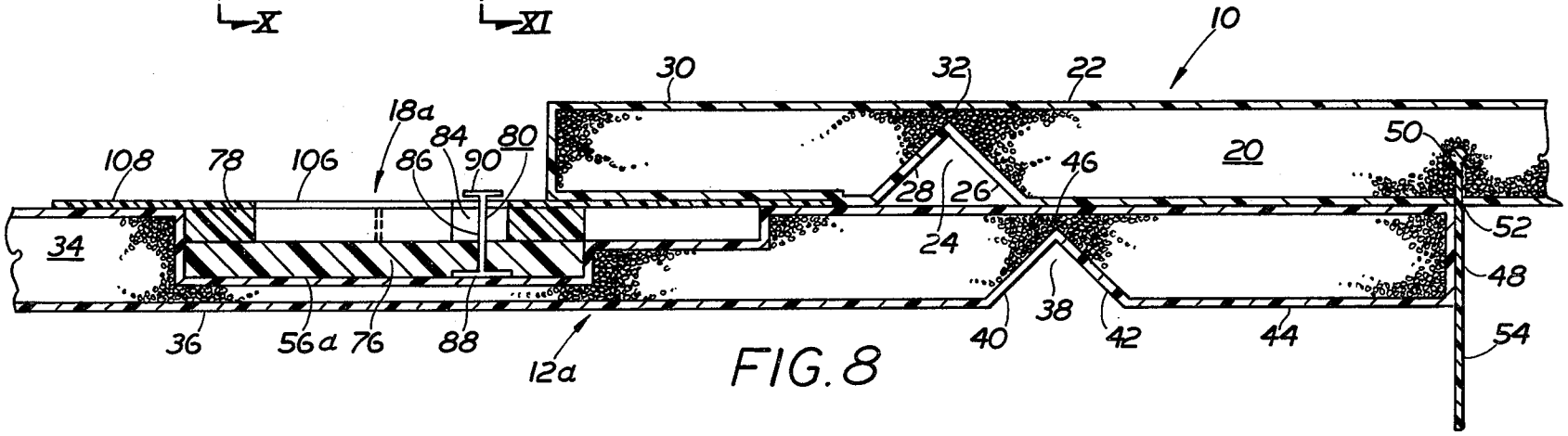
FIG. 8 is similar to FIG. 6, but shows the roof and sidewall panels in an initial stage of assembly, before the panels are fully assembled and set up and thereby detachably secured together.

In order to assemble and set up the building structure or shelter embodying the modified panel securing devices, the roof and sidewall panels are initially arranged as shown in FIGS. 8 and 9, i.e., with the plane of the interface between them disposed horizontally. Then, maintaining the roof panel in a horizontal position, it is raised. As the roof panel is elevated the sidewall panel and the flange 30 of the roof panel fold inward and downward toward the underside of the roof panel until the sidewall panel is in an upright position, as shown in FIGS. 6 and 7. In the meantime, due to folding of the flange 30, the part 78 of the device 18*a* slides upwardly in the depression 56*a*, and the part 80 moves downwardly to the bottom of the slot 82 with its head 90 overhanging the opposite sides of the slot. At the same time, the beveled end of the part 78 enters the way 104 between the flanges 96 and 98. Thus, the parts 76 and 78 are detachably interlocked, and the parts 78 and 80 are detachably interlocked. Accordingly, the flange 30, and consequently the roof panel, is detachably secured doubly to the sidewall panel automatically as an incident of assembling and setting up the panels in position. Assembling and setting up of the panels and securing them together are not separate and distinct operations. They are part and parcel of the same operation. Likewise, dismantling the building structure or shelter after the roof and sidewall panels have been assembled, set up and detachably secured together, as illustrated in FIG. 6, and returning it to the condition thereof illustrated in FIG. 8 is effected in a single operation. The roof panel is relowered. As a consequence, the sidewall panel and the flange 30 of the roof panel are unfolded, i.e., they are turned upwardly and outwardly respectively about the hinges 46 and 32 until the interface between the panels is approximately in a horizontal position, as shown in FIG. 8. As the roof panel is lowered the part 78 of the device 18*a* returns to its initial position in the depression 56*a*. If need be, use is made of the pull-tab 108. The part 80 moves relative to the part 78 in the opposite direction back to the initial position thereof, finally registering with the enlargement 84 of the slot 82, as shown in FIG. 9. At the same time, the beveled end of the part 78 moves out from between the flanges 96 and 98, i.e., out of the way 104. Thus, the flange 30, and consequently the roof panel, is detached from the sidewall panel automatically as an incident of lowering the roof panel and unfolding the sidewall panel and the flange 30 of the roof panel. Detaching the panels from each other and knocking them down are not separate and distinct operations. They are part and parcel of the same operation. Complete separation of the sidewall panel from the roof panel is effected by using the pull-tab 54 to pull the bead 50 out of the slot 52.

Figure 12:
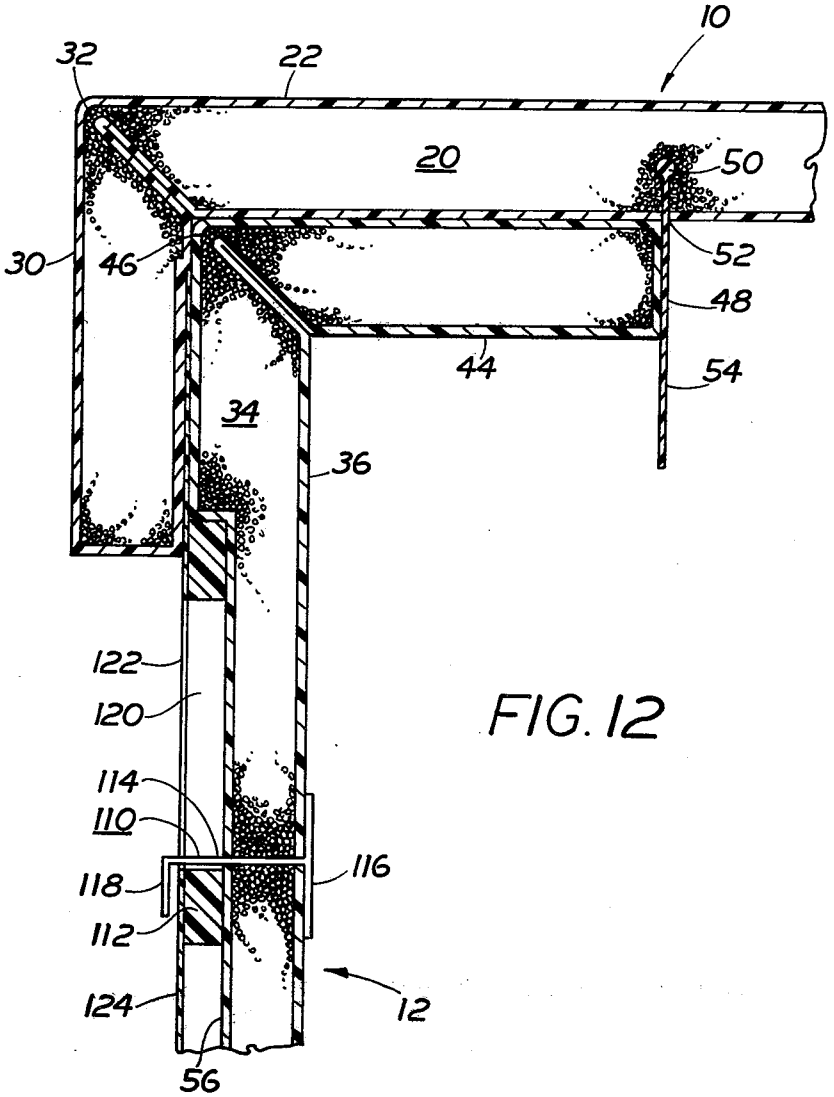
FIG. 12 is similar to FIGS. 2 and 6, but shows how the roof panel is detachably secured to the sidewall panel by another modified device.
Figure 13:
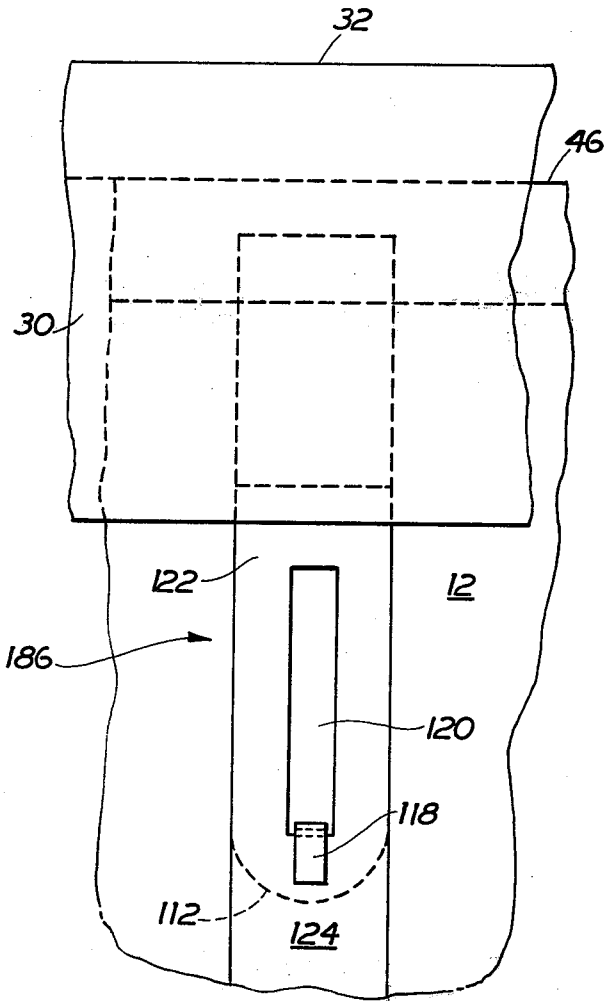
FIG. 13 is a view of the panel securing device illustrated in FIG. 12 looking at it from outside the shelter.
Figure 15:
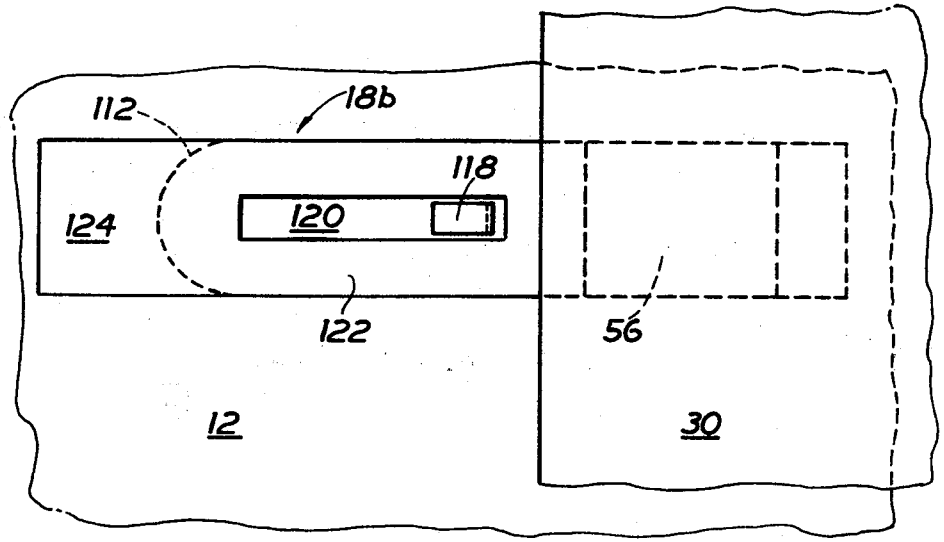
FIG. 15 is a view looking at the panel securing device, as illustrated in FIG. 14.
Figure 14:
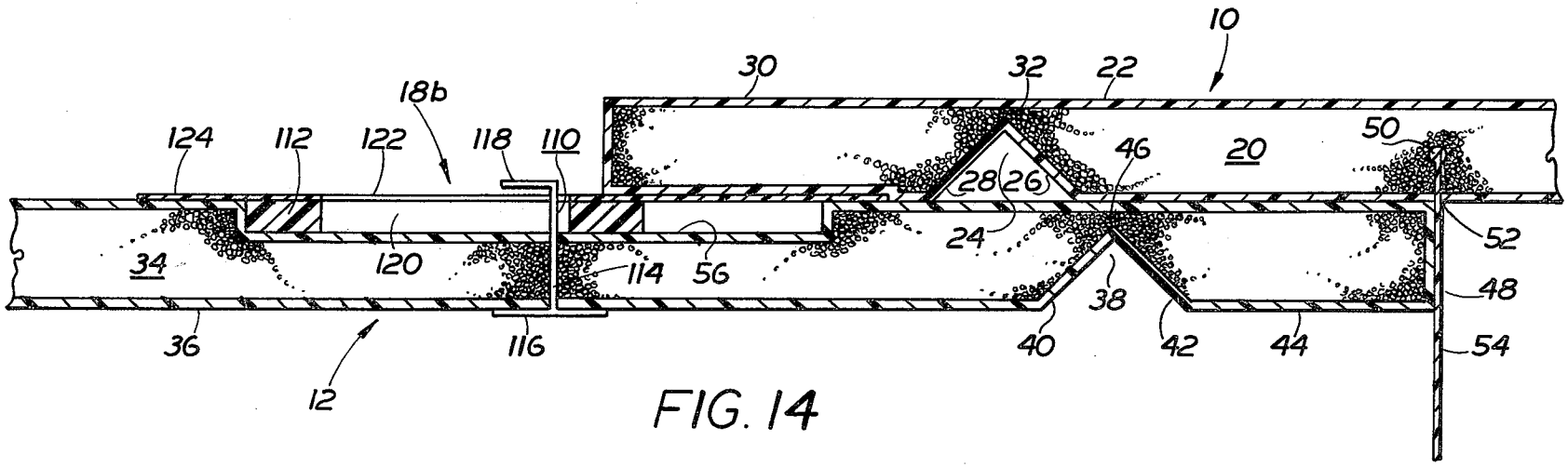
FIG. 14 is similar to FIG. 12, but shows the roof and sidewall panels in an initial stage of assembly, before the panels are fully assembled and set up and thereby detachably secured together.

Another modified device for detachably securing the roof and sidewall panels together is illustrated in FIGS. 12–15. Referring particularly to FIGS. 14 and 15, the device, designated 18*b*, comprises parts 110 and 112. The part 110 extends through the sidewall panel 12 and is firmly embedded therein. The stem of the part 110, designated 114, extends through the bottom of the depression 56 and terminates at opposite ends respectively in an enlarged head 116 and a head in the form of a hook 118. The part 112 is a plate member slidably nested in the depression 56 and provided with a slot 120. The part 112 is affixed to the flange 30 of the roof panel 10 by a flexible strip of sheet material 122, one end portion of which underlies the flange 30, the intermediate portion of which overlies the part 112 and the opposite end portion of which extends beyond the part 112 to provide a pull-tab 124. The strip may be affixed by any suitable means to the flange 30 of the roof panel 10 and to the part 112. The stem 114 of the part 110 extends through the slot 120. The hook 118 of the part 110 does not overhang any part of the edge which defines the slot 120, as a consequence of which the parts 110 and 112 are not interlocked. The minimum length of the slot 120 is critical. The length of the slot must be at least sufficient to allow relative movement of the parts 110 and 120 in the order of twice the thickness of the roof panel 10. Preferably, the part 110 is made of metal, and the part 112 and strip 122 are made of suitable plastic material.

In order to assemble and set up the building structure or shelter, the roof and sidewall panels are initially arranged as shown in FIGS. 14 and 15, i.e., with the plane of the interface between them disposed horizontally. Then, maintaining the roof panel in a horizontal position, it is raised. As the roof panel is elevated the sidewall panel and the flange 30 of the roof panel fold inward and downward toward the underside of the roof panel until the sidewall panel is in an upright position, as shown in FIGS. 12 and 13. In the meantime, due to folding of the flange 30, the part 112 of the device 18*b* slides upwardly in the depression 56, and the part 110 moves downwardly to the bottom of the slot 120, whereupon the hook 118 of the part 110 overlies the edge of the slot defining the bottom of the slot. Thus, the flange 30, and consequently the roof panel, is detachably secured to the sidewall panel automatically as an incident of assembling and setting up the panels in position. Assembling and setting up the panels and securing them together are not separate and distinct operations. They are part and parcel of the same operation. Likewise, dismantling the building structure or shelter after the roof and sidewall panels have been assembled, set up and detachably secured together, as illustrated in FIG. 12, and returning it to the condition thereof illustrated in FIG. 14 is effected in a single operation. The roof panel is relowered. As a consequence, the sidewall panel and the flange 30 of the roof panel are unfolded, i.e., they are turned upwardly and outwardly respectively about the hinges 46 and 32 until the interface between the panels is approximately in a horizontal position, as shown in FIG. 14. As the roof panel is lowered the part 112 of the device 18*b* returns to its initial position in the depression 56. If need be, use is made of the pull-tab 124. The part 110 moves relative to the part 112 in the opposite direction back to the initial position thereof, as shown in FIG. 15. Thus, the flange 30, and consequently the roof panel, is detached from the sidewall panel automatically as an incident of lowering the roof panel and unfolding the sidewall panel and the flange 30 of the roof panel. Detaching the panels from each other and knocking them down are not separate and distinct operations. They are part and parcel of the same operation. Complete separation of the sidewall panel from the roof panel is effected by using the pull-tab 54 to pull the bead 50 out of the slot 52.

Figure 16:
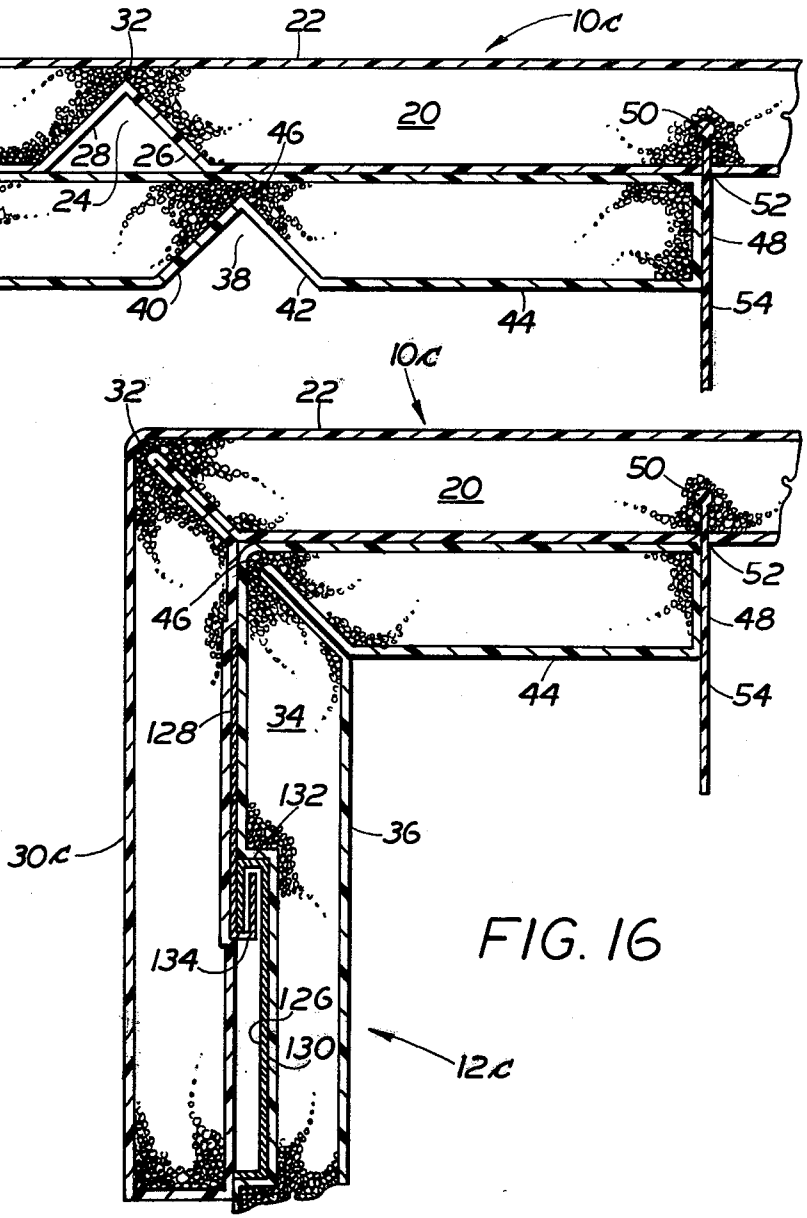
FIG. 16 is similar to FIGS. 2, 6 and 12, but shows how the roof panel is detachably secured to the sidewall panel by still another modified device.
Figure 17:
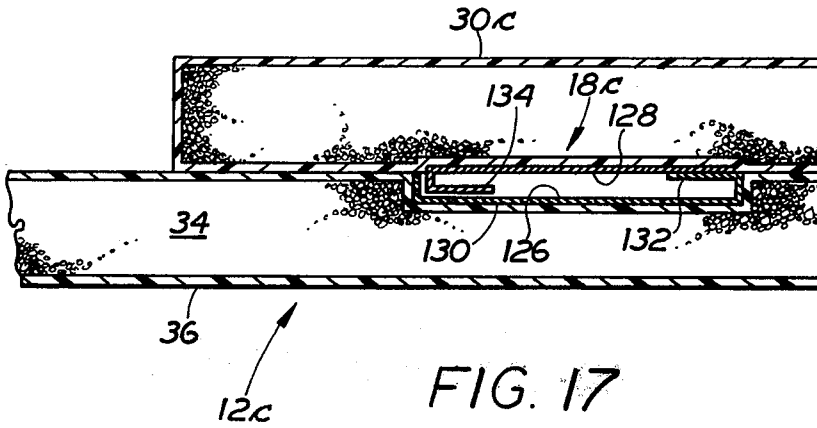
FIG. 17 is similar to FIG. 16, but shows the roof and sidewall panels in an initial stage of assembly, before the panels are fully assembled and set up and thereby detachably secured together.

Still another modified device for detachably securing the roof and sidewall panels together is illustrated in FIGS. 16 and 17. Referring particularly to FIG. 17, the device, designated 18*c*, comprises a pair of elongated members 126 and 128 made of suitable sheet material and extending along the flange of the roof panel, designated 30*c*. The member 126 is fixedly nested in a depression 130 in the outer surface of the sidewall panel 12*c*, while the member 128 overlies the member 126 and is fixedly nested in the underside of the flange 30*c*. A longitudinally extending marginal area of the member 126 is turned back upon itself to form a hook 132, and a longitudinally extending marginal area of the member 128 is turned back upon itself to form a second hook 134.

In order to assemble and set up the building structure or shelter, the roof and sidewall panels are initially arranged as shown in FIG. 17, i.e., with the plane of the interface between them disposed horizontally. Then, maintaining the roof panel in a horizontal position, it is raised. As the roof panel, designated 10*c*, is elevated the sidewall panel and the flange 30*c* of the roof panel fold inward and downward toward the underside of the roof panel until the sidewall panel is in an upright position, as shown in FIG. 16. In the meantime, due to folding of the flange 30*c*, the member 128 slides upwardly relative to the member 126 until the hooks 132 and 134 interlock. Thus, the flange 30*c*, and consequently the roof panel, is detachably secured to the sidewall panel automatically as an incident of assembling and setting up the panels in position. Assembling and setting up the panels and securing them together are not separate and distinct operations. They are part and parcel of the same operation. Likewise, dismantling the building structure or shelter after the roof and sidewall panels have been assembled, set up and detachably secured together, as illustrated in FIG. 16, and returning it to the knocked down condition thereof illustrated in FIG. 17 is effected in a single operation. The roof panel is relowered. As a consequence, the sidewall panel and the flange 30*c* of the roof panel are unfolded, i.e., they are turned upwardly and outwardly respectively about the hinges 46 and 32 until the interface between the panels is approximately in a horizontal position, as shown in FIG. 17. As the roof panel is lowered the members 126 and 128 shift relative to each other from their positions shown in FIG. 16 to their positions shown in FIG. 17, wherein the hooks 132 and 134 are not interlocked. Thus, the flange 30*c*, and consequently the roof panel, is detached from the sidewall panel automatically as an incident of lowering the roof panel and unfolding the sidewall panel and the flange 30*c* of the roof panel. Detaching the panels from each other and knocking them down are not separate and distinct operations. They are part and parcel of the same operation. Complete separation of the sidewall panel from the roof panel is effected by using the pull-tab 54 to pull the bead 50 out of the slot 52.

While in accordance with the provisions of the patent statutes, I have illustrated and described the best forms or embodiments of my invention now known to me, it will be apparent to those skilled in the art that changes may be made in the form of the structure described without departing from the spirit and scope of the invention as set forth in the appended claims.

What I claim is:

1. In a knock-down assembly of structural panels, the combination comprising

A. a pair of substantially thick structural panels set up at approximately right angles to each other and adapted for being knocked down and thereby disposed with marginal areas thereof in mutually overlying relation, (1) the first of said panels being provided with a recess defining the main body of said first panel and a flange, said flange being folded over the second of said panels, and said recess being opened up when said panels are knocked down and disposed as aforesaid thereby to form a deep groove with opposite sides angularly spaced approximately 90 degrees apart, and B. means for detachably securing said panels together including (1) a pair of interlocked panel securing parts respectively carried by said panels and adapted for automatically disengaging when said assembly is knocked down and automatically interlocking again when said panels are reassembled.

2. The combination according to claim 1 wherein the first panel is disposed substantially in a horizontal position, the second panel is disposed in an upright position, the flange of said first panel is folded down over the top of said second panel, the panel securing part carried by said first panel is affixed to the flange thereof and extends downwardly therefrom along said second panel, and the panel securing part carried by said second panel is affixed thereto and projects through an opening in said panel securing part carried by the first panel, terminating in means overhanging the periphery of said opening for being thereby interlocked with said panel securing part carried by said first panel.

3. The combination according to claim 2 wherein the opening in the panel securing part affixed to the flange of the first panel is elongated along a line approximately normal to said flange, the panel securing part affixed to the second panel extends through a lower portion of said opening, and said opening extends upwardly from said panel securing part affixed to the second panel a distance approximately equal to twice the thickness of said first panel.

4. The combination according to claim 3 wherein the panel securing part affixed to the second panel comprises an element provided with a neck projecting freely through the elongated opening in the panel securing part affixed to the flange of the first panel and terminating in a head overhanging the periphery of said opening, an enlargement in said elongated opening is disposed at a distance from said element approximately equal to twice the thickness of said first panel, and said head is of a size for passing freely through said enlargement, and, when the assembly of panels is knocked down, being disposed for registering with said enlargement.

5. The combination according to claim 2 wherein the panel securing part affixed to the flange of the first panel consists of a plate member suspended from said flange by a strip of flexible sheet material affixed by an upper end portion thereof to said flange and depending freely therefrom, said strip is disposed between the opposed surfaces of said flange of the first panel and said second panel, said plate member is slidably nested in a depressed area in the opposed face of said second panel and extending downwardly beyond said plate member a distance at least equal to the relative movement of said panel securing parts when the assembly of panels is knocked down or set up.

6. The combination according to claim 5 wherein the strip of flexible sheet material extends downwardly beyond the plate member freely a distance sufficient to afford a pull tab.

7. The combination according to claim 1 wherein the first panel is disposed substantially in a horizontal position, the second panel is disposed in an upright position, each of said panels is provided with a flange disposed in mutually overlying relation to the main body of the other panel, and a member affixed to said flange of the second panel and extending parallel thereto is provided with a longitudinally extending marginal area projecting upwardly into a groove in the undersurface of the main body of said first panel for detachably securing said flange of the second panel to the main body of said first panel.

8. The combination according to claim 7 wherein the member detachably securing the flange of the second panel to the main body of the first panel is affixed to the longitudinally extending narrow edge of said flange of the second panel and is provided with a longitudinally extending marginal area extending downwardly beyond said flange freely a distance sufficient to provide a pull tab.

9. The combination according to claim 1 wherein the first panel is disposed substantially in a horizontal position, the second panel is disposed in an upright position, the flange of said first panel is folded down over the top of said second panel, the panel securing part affixed to said second panel consists of a plate member embedded in said second panel and carrying plural means each interlocked with the panel securing part affixed to the flange of said first panel.

10. The combination according to claim 9 wherein a first one of the plural means carried by the plate member embedded in the second panel consists of a pair of laterally spaced undercut flanges raised on said plate member, and the opposite side marginal areas of the panel securing part affixed to the first panel are respectively engaged in said undercuts, the panel securing part affixed to said flange of the first panel being shiftable in a way provided by said undercuts to a position wherein said opposite side marginal areas are free of said flanges and said panel securing parts are free each from the other.

11. The combination according to claim 10 wherein a second one of the plural means carried by the plate member embedded in the second panel consists of an element provided with a neck projecting freely through an elongated opening in the panel securing part affixed to the flange of the first panel and terminating in a head overhanging the periphery of said opening, said elongated opening extends upwardly from said element a distance approximately equal to twice the thickness of said first panel, said element is shiftable in said elongated opening to a position wherein it is free of said panel securing part affixed to the flange of said first panel at the same time that the first of the plural means carried by said plate member embedded in the second panel is free of the panel securing part carried by the flange of the first panel.

12. The combination according to claim 11 wherein an enlargement in the elongated opening provided in the panel securing part affixed to the flange of the first panel is disposed at a distance from the element carried by the panel securing part affixed to the second panel approximately equal to twice the thickness of said first panel, the head of said element is of a size for passing freely through said enlargement, and, when the assembly of panels is knocked down, is disposed for registering with said enlargement.

13. The combination according to claim 1 wherein the first panel is disposed substantially in a horizontal position, the second panel is disposed in an upright position, the flange of said first panel is folded down over the top of said second panel, the panel securing part affixed to said flange consists of a first plate member extending along said flange with a longitudinally extending marginal area thereof offset from the main body thereof, and the panel securing part affixed to said second panel consists of a second plate member extending along said first plate member with a longitudinally extending marginal area thereof hooked over said longitudinally extending marginal area of said first plate member, said offset marginal area of the first plate member being disposed in a depressed area of said second plate member and being shiftable in said depressed area a distance sufficient for freeing it from engagement with said second plate member when said panels are knocked down.

14. The combination according to claim 13 wherein the area of the first plate member offset from the main body thereof is the longitudinally extending lower marginal area of the first plate member turned up and back upon said main body for hookedly engaging said second plate member.

* * * * *